US007703730B2

(12) United States Patent
Best, Jr. et al.

(10) Patent No.: US 7,703,730 B2
(45) Date of Patent: Apr. 27, 2010

(54) FASTENERLESS ATTACHMENT SYSTEM APPLIED TO VEHICLE ENGINE COOLING MODULE COMPONENTS

(75) Inventors: William F. Best, Jr., Waterford, MI (US); Christopher Wisniewski, Ann Arbor, MI (US); Sang Bae Park, Northville, MI (US)

(73) Assignee: DENSO International America, Inc., Southfield, MI (US)

( * ) Notice: Subject to any disclaimer, the term of this patent is extended or adjusted under 35 U.S.C. 154(b) by 578 days.

(21) Appl. No.: 11/584,392

(22) Filed: Oct. 20, 2006

(65) Prior Publication Data

US 2008/0099641 A1 May 1, 2008

(51) Int. Cl.
*A47B 96/06* (2006.01)

(52) U.S. Cl. ..... 248/220.22; 248/232; 165/41; 165/51; 165/67

(58) Field of Classification Search ..... 248/213.3, 248/213.4, 220.22, 221.11, 224.51, 232, 248/233; 165/41, 51, 67
See application file for complete search history.

(56) References Cited

U.S. PATENT DOCUMENTS

| | | | | |
|---|---|---|---|---|
| 3,980,132 | A | 9/1976 | Mitchell | |
| 5,139,080 | A * | 8/1992 | Bolton et al. | 165/67 |
| 5,219,016 | A * | 6/1993 | Bolton et al. | 165/41 |
| 5,341,871 | A | 8/1994 | Stelzer | |
| 5,435,511 | A * | 7/1995 | Hsu | 248/206.3 |
| 5,996,684 | A * | 12/1999 | Clifton et al. | 165/67 |
| 6,071,078 | A | 6/2000 | Schlegel | |
| 6,318,450 | B1 * | 11/2001 | Acre | 165/67 |
| 6,527,044 | B2 * | 3/2003 | Mangold | 165/67 |
| 6,615,604 | B2 | 9/2003 | Neufang | |
| 6,668,956 | B1 * | 12/2003 | Pelage et al. | 180/68.4 |
| 6,691,767 | B2 | 2/2004 | Southwick | |
| 6,997,239 | B2 | 2/2006 | Kato | |
| 7,007,744 | B2 * | 3/2006 | Kalbacher | 165/67 |
| 7,044,203 | B2 | 5/2006 | Yagi | |
| 7,325,592 | B2 * | 2/2008 | Cristante et al. | 165/121 |
| 2006/0213640 | A1 * | 9/2006 | Matsuoka et al. | 165/67 |
| 2006/0237175 | A1 * | 10/2006 | Hara | 165/140 |
| 2007/0089855 | A1 * | 4/2007 | Heine | 165/67 |

* cited by examiner

*Primary Examiner*—J. Allen Shriver, II
*Assistant Examiner*—Bradley H Duckworth
(74) *Attorney, Agent, or Firm*—Harness, Dickey & Pierce, PLC

(57) ABSTRACT

A fastening system fastens a radiator, an electric fan support and a fan shroud as a single unit. The radiator has lower and upper posts to which slotted plates protruding from the fan support and fan shroud fit over. A structural sandwich is formed with the fan support lying between the radiator and the fan shroud. A flexible lever arm with a locking tab lies adjacent to the upper post of the radiator and connects to the radiator. When the fan support is fitted over the posts, the top plate of the electric fan support locks under the first lever arm tab. The fan shroud also has two slotted plates that also fit over the posts of the radiator. The fan shroud locks into place when a lever arm with a tab on the fan shroud locks under a tab that protrudes from the top plate of the fan support.

14 Claims, 7 Drawing Sheets

FASTENERLESS ATTACHMENT SYSTEM APPLIED TO VEHICLE ENGINE COOLING MODULE COMPONENTS

FIELD

The present disclosure relates to a component attachment system. More specifically, the present disclosure relates to the fastenerless attachment of multiple components in a vehicle engine cooling module.

BACKGROUND

The statements in this section merely provide background information related to the present disclosure and may not constitute prior art. Traditionally, engine cooling modules have been assembled using traditional fasteners, such as screws or a bolt and nut arrangement. While these fasteners have proven satisfactory for their purpose, such traditional fastener methods have not been without their share of limitations.

There are multiple limitations of traditional fastener systems. One such limitation is that traditional fasteners, whether clips, screws, or a bolt and nut combination, may vibrate loose due to vibrations caused by an engine or road surface as a vehicle travels on a road. Loose fasteners may eventually fall out of their originally secure location. Another limitation is that traditional fasteners are physically separate components from the parts that need to be fastened, and as such, the fasteners must be brought to the parts for which fastening is desired. This represents an added fastener cost and assembly time to install such fasteners. Another limitation is that in a location where installation and removal space of the attached parts is limited, traditional fasteners may be difficult or even prevent certain designs because traditional fasteners require space for installation and removal tools as well as space for the person or machine who installs such parts. Still yet another limitation is that traditional fastening devices do not permit stacking, or a series assembly, of multiple parts of a module, that can be accomplished in a fast, convenient, and reliable manner.

What is needed then is an attachment device that permits a fast and secure connection of parts, such as parts assembled in series, without the space and tools necessary to install separate, traditional fasteners.

SUMMARY

A fastening system applied to a cooling module utilizes three major pieces: a radiator, an electric fan support, and a fan shroud. The radiator has two posts protruding from one side, or one tank, one at a lower location and one at an upper location. The electric fan support has a bottom plate that has a first slot or notch in it such that the bottom plate straddles or fits over the lower post, and a top plate that has a second slot or notch such that the top plate straddles or fits over the second post. The lower and upper posts have two levels of notches that correspond with the notches of the plates to permit the tight fit of the electric fan support against the radiator.

To effectively lock the electric fan support against the radiator, a flexible prong with a protruding tab resides on the radiator next to the upper post. The protruding tab fits over the top plate and prevents the electric fan support from moving off of the lower and upper posts. Pressing the flexible prong releases the tab from the top plate and permits the fan support to be lifted from the radiator.

The fan shroud also has a bottom plate with a first slot or notch in it such that the bottom plate straddles or fits over the lower post, and a top plate that has a second slot or notch such that the top plate straddles or fits over the second post. The notches in the plates of the fan shroud fit within the second set of notches in the lower and upper posts. That is, the electric fan support fits into the lower notches of the posts while the fan shroud fits within the upper notches of the posts. With the fan shroud held firmly against the fan support and the fan support held firmly against the radiator, the second latching or fastening mechanism engages.

The second latching mechanism associated with the top plate of the fan shroud has a flexible prong with a protruding tab connected to the top plate. When the fan shroud plates are placed over the lower and upper posts, the tab and flexible prong are biased when they contact a tab on the top plate of the electric fan support. When the fan support is fully pressed into position, the tab on the flexible prong lodges under the tab on the top plate of the fan support when the flexible prong returns to its unbiased position. With the tab of the flexible prong of the fan shroud under the tab of the top plate of the fan support, the fan shroud is prevented from moving off of the first and second posts. Both of the fan support and the fan shroud are prevented from moving laterally off of the lower and upper posts due to the notches, and from moving vertically off of the posts due to the latching mechanisms at the top plates.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
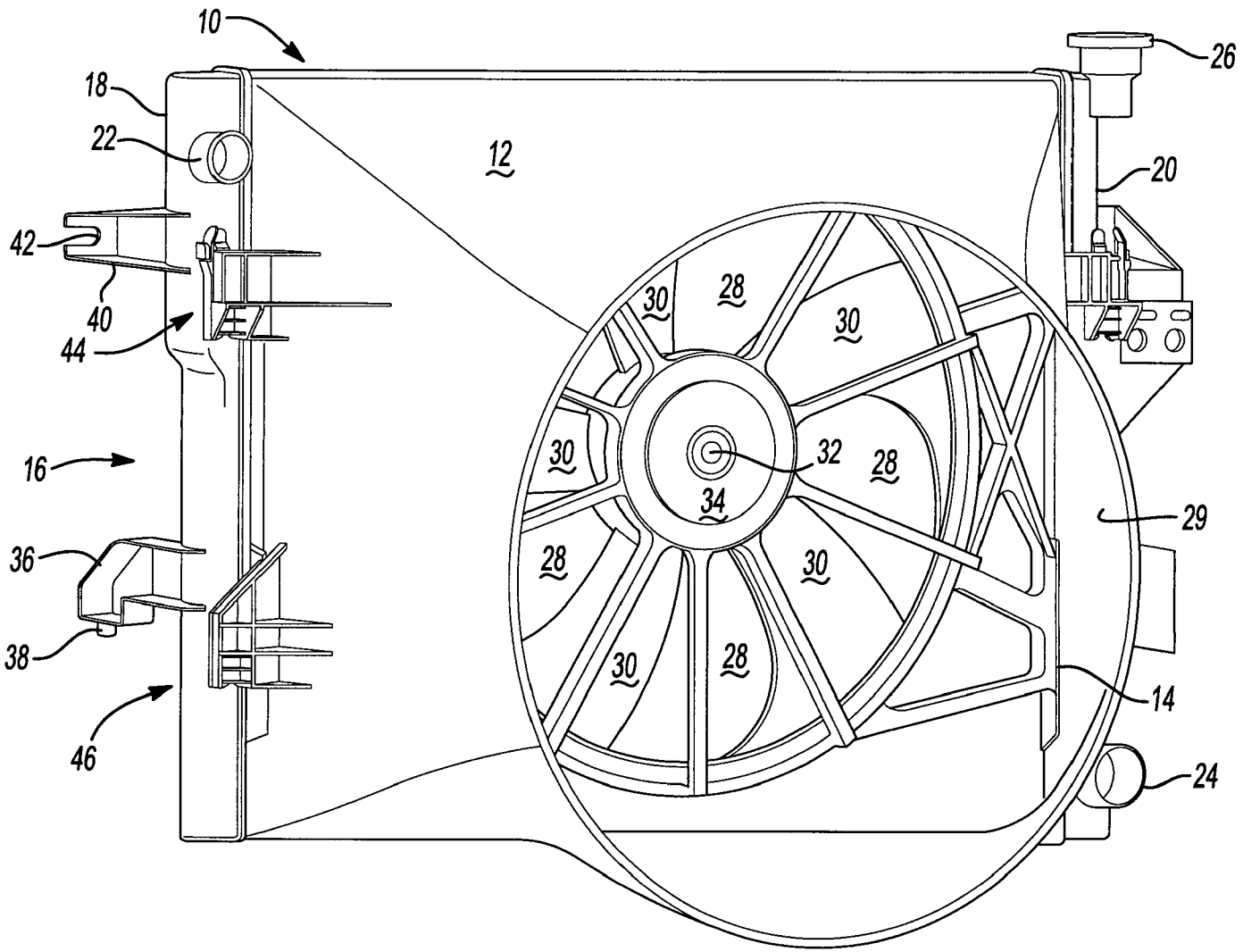
FIG. 1 is a perspective view of an engine cooling module employing a fastening system according to teachings of the present invention.

The following description is merely exemplary in nature and is not intended to limit the present disclosure, application, or uses. It should be understood that throughout the drawings, corresponding reference numerals indicate like or corresponding parts and features.

FIG. 1 is a perspective view of an engine cooling module 10 that employs a fastening system according to teachings of the present invention. The engine cooling module 10 depicted in FIG. 1 is an assembly of three major members, a fan shroud 12, an electric fan support 14, and a radiator 16. The radiator 16 is known as the first member, the electric fan support 14 is known as the second member, and the fan shroud 12 is known as the third member. The radiator 16, or first member, has a left radiator tank 18, which is also known as a left tank or a top tank, and a right radiator tank 20, which is also known as a right tank or a bottom tank. The left radiator tank 18 is known as the top tank because it employs a top inlet 22, also known as a top tank inlet, while the right radiator tank 20 is known as the bottom tank because it employs a bottom outlet 24, also known as a bottom tank outlet. The bottom tank 20 employs a radiator coolant inlet 26, which is the location where liquid coolant such as anti-freeze or water is added to the engine cooling system. The top inlet 22 is where liquid coolant continuously enters the radiator 16 while the engine (not shown) is running. The bottom outlet 24 is where the liquid coolant continuously exits the radiator 16 while the engine is running.

The liquid coolant generally flows from the top tank 18 to the bottom tank 20 via the radiator core 28. The radiator core 28 consists of multiple liquid coolant passages surrounded by air gaps, through which air passes to cool or remove heat from the liquid coolant. The radiator core 28 is similar to existing radiator cores, as are known in the art. Continuing, a fan blade 30 spins about a fan central location or fan axis 32, and when operating, air is pulled through the radiator core 28 by the fan blade 30 which removes heat from the liquid coolant flowing through the radiator core 28. The fan blade 30 is driven or rotated by an electric motor 34 or fan motor. The fan shroud 12 has a shroud opening 29 for an engine driven fan (not shown), that is separate from the electric motor 34 and fan blade 30. The engine driven fan also pulls air through the radiator core 28.

The radiator 16 mounts within an engine compartment (not shown) of a vehicle (not shown) with brackets. More specifically, on its bottom side, a bottom radiator bracket 36 has a post 38, which fits into a hole within the vehicle engine compartment. Once the post 38 is inserted, the top radiator bracket 40 with its slot 42, is inserted over a corresponding post, such as a bolt (not shown), within the engine compartment. Similar brackets are on the right side of the radiator 16 to facilitate mounting.

Figure 2:
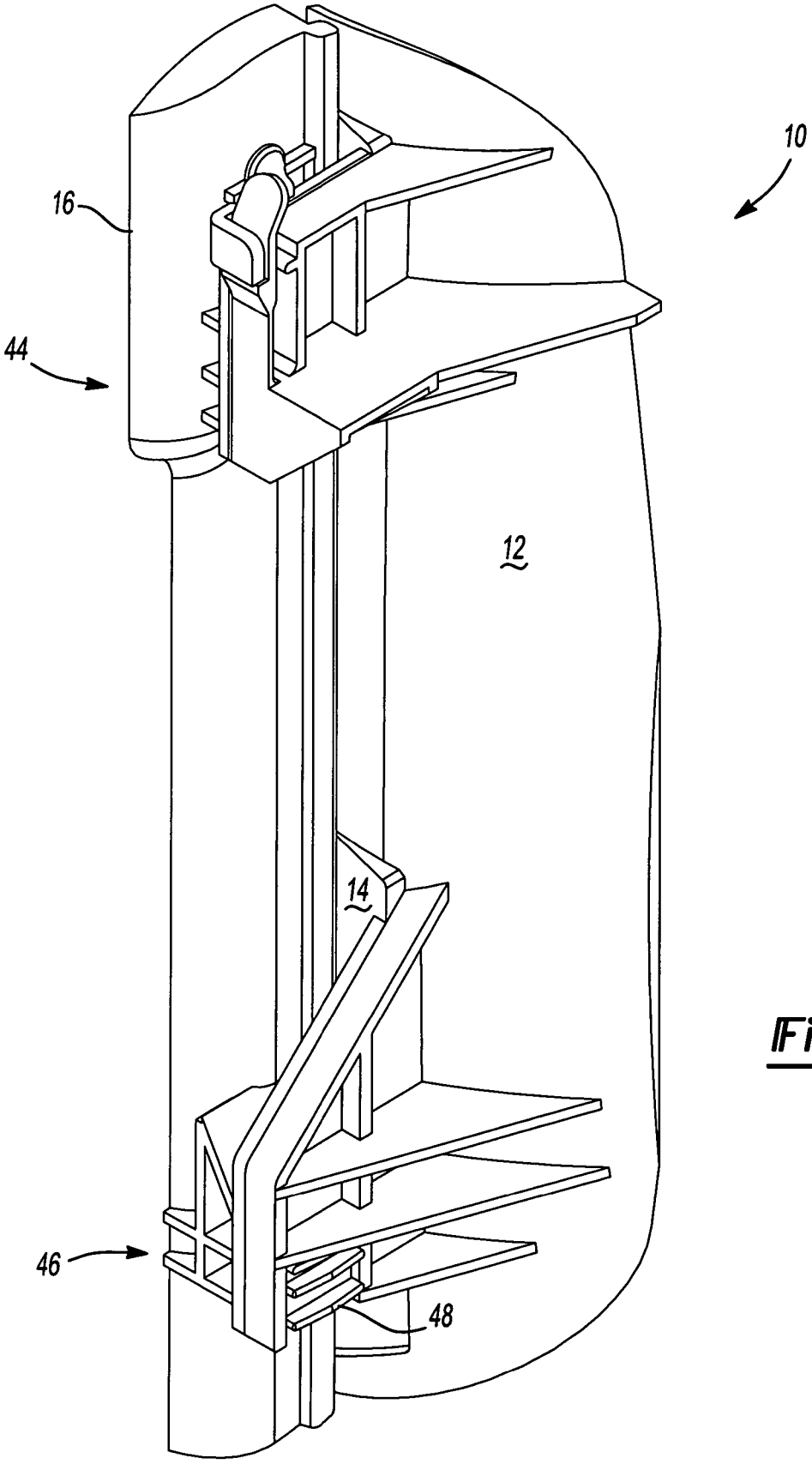
FIG. 2 is an enlarged perspective view of an assembled cooling module utilizing the fastening system.

Now a more detailed description of the operative workings of the teachings of the present invention will be presented. FIG. 1 depicts a perspective view of a top connection device 44 and a bottom connection device 46. FIG. 2 is an enlarged perspective view of a portion of an assembled cooling module assembly 10 utilizing the top connection device 44 and the bottom connection device 46. More specifically, FIG. 2 depicts the electric fan support 14, or second member, installed onto a lower or bottom radiator post 48 at the bottom connection device 46 and the electric fan support 14 snapped or secured into position at the top connection device 44.

Figure 3:
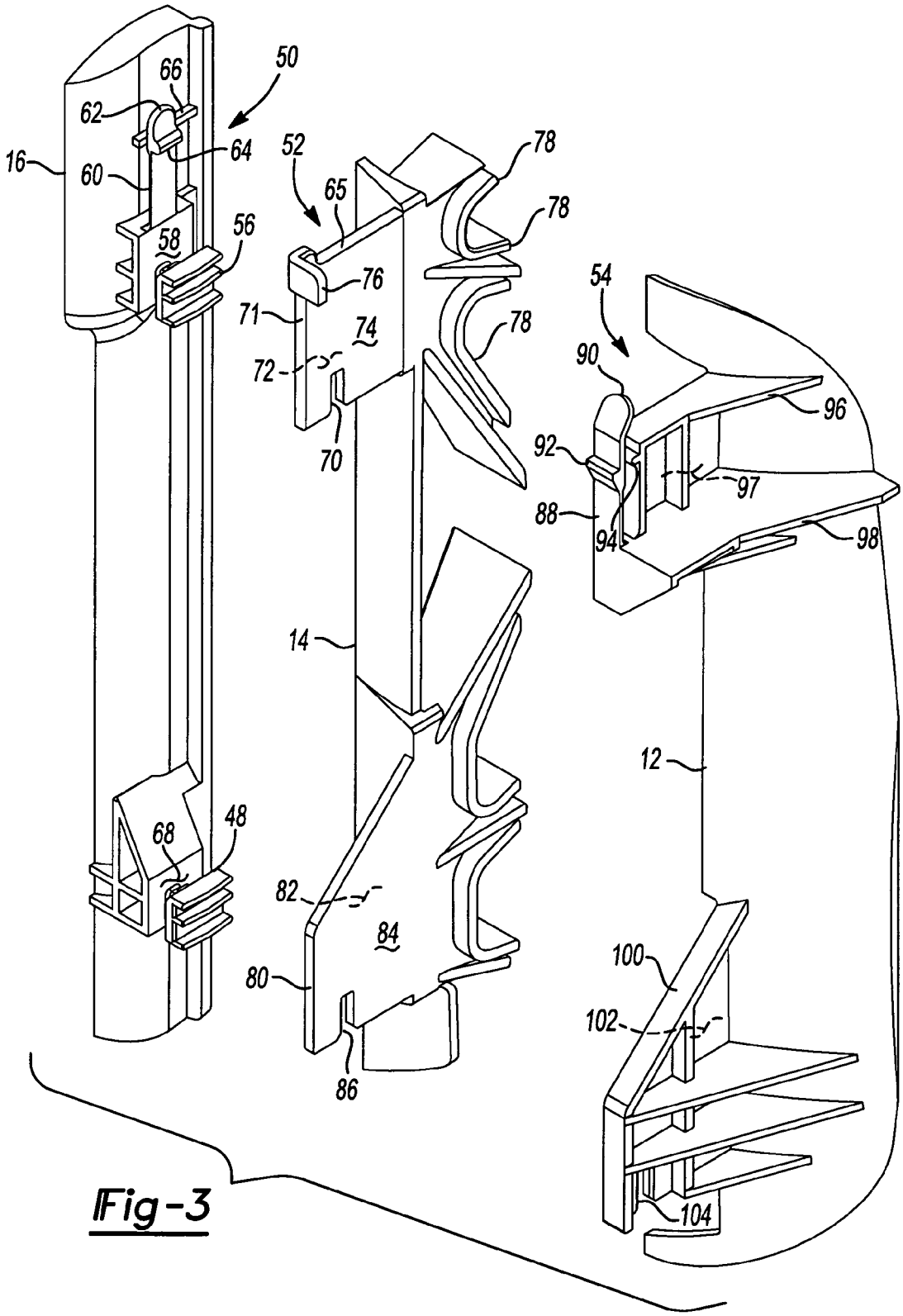
FIG. 3 is an enlarged partial perspective view of an unassembled engine cooling module utilizing the fastening system.

FIG. 3 is an enlarged partial perspective view of an unassembled engine cooling module 10 utilizing the fastening system. More specifically, FIG. 3 depicts three portions of the top connection device 44. Radiator top latch 50, top fan support plate 52, and the fan shroud latch 54, generally form the top connection device 44. Continuing, the radiator top latch 50 has a radiator top post 56 or upper post, a top latch surface 58, a top spring lever arm 60 with a top spring tab 62, a latch tab 64, and a stop 66 or over bend stop that prevents overstressing the lever arm 60 when a person presses the spring tab 62. The portions making up the top connection device 44 may be molded into the radiator top tank 18. The advantage of such a molded feature is the elimination of separate fasteners and their associated handling costs and installation costs. Additionally, such fasteners may fall out over time due to vibrations in a vehicle. FIG. 3 also depicts the radiator bottom post 48, but a bottom surface 68 adjacent to the bottom post 48.

FIG. 3 also depicts fastening portions associated with the top fan support plate 52 of the electric fan support 14. Continuing, the top fan support plate 52 or first top plate has a top plate slot, groove or notch 70, a main plate portion 71 having a top fan support plate radiator side 72, a top fan support plate shroud side 74, and a top plate extension tab or plate tab 76. Adjacent to the top fan support plate 52 is structural webbing 78 that provides structural support to the electric fan support 14. Continuing with the electric fan support 14 of FIG. 3, a first bottom plate or bottom fan support plate 80 is depicted. The bottom fan support plate 80 has a bottom fan plate radiator side 82, a bottom fan plate shroud side 84, and a bottom fan plate groove, slot or notch 86.

Figure 8:
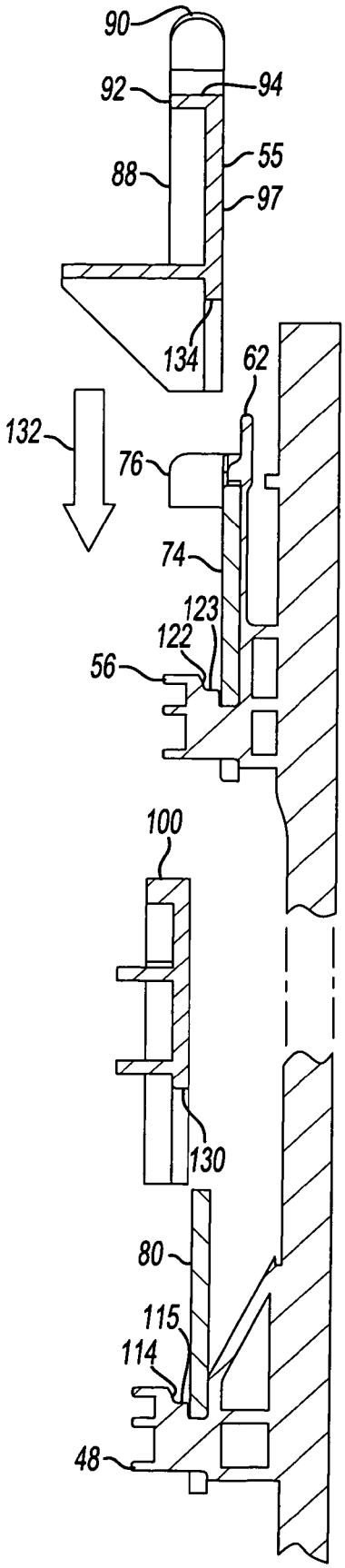
FIG. 8 is an enlarged cross-sectional view depicting a pre-assembly stage of the engine cooling module employing the fastening system.
Figure 9:
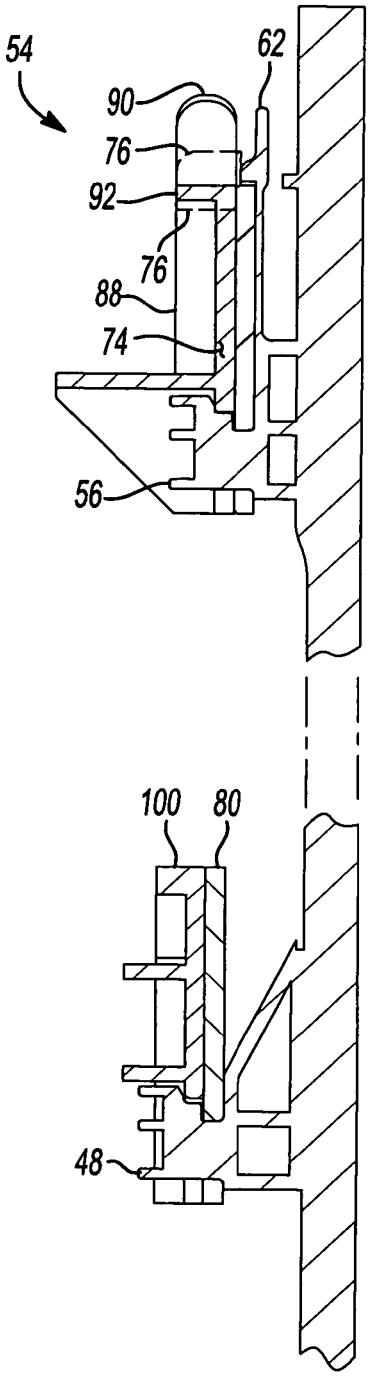
FIG. 9 is an enlarged cross-sectional view depicting an assembled engine cooling module employing the fastening system.

FIG. 3 also depicts fastening elements of the fan shroud 12, or third member. Continuing with the fan shroud latch 54, also depicted is a fan shroud spring lever 88 or lever arm, a fan shroud spring lever tab 90, a fan shroud spring lever lock tab or protrusion 92, and a fan shroud stop 94 or over bend stop. The fan shroud latch 54 is primarily supported by a fan shroud latch top web 96 and a fan shroud latch bottom web 98. The webs 96, 98 support the fan shroud latch surface 97, which faces the electric fan support 14. More specifically, when assembled, the fan shroud latch surface 97 abuts the surface 74 of the plate 52. Continuing with reference to FIGS. 3 and 8, further assembly of the fan shroud 12 to the electric fan support 14 involves aligning the fan shroud bottom plate groove, slot or notch 104 within the bottom post shallow slot, notch or groove 115 between the radiator bottom post groove outer face 114 and the bottom fan support plate 80. At the same time that alignment of the fan shroud bottom plate 100 (second bottom plate) occurs, so does alignment of the fan shroud latch 54 (FIG. 9). The fan shroud bottom plate (second bottom plate) surface 102 abuts the bottom fan plate (first bottom plate) shroud side 84 (FIG. 4).

Figure 4:
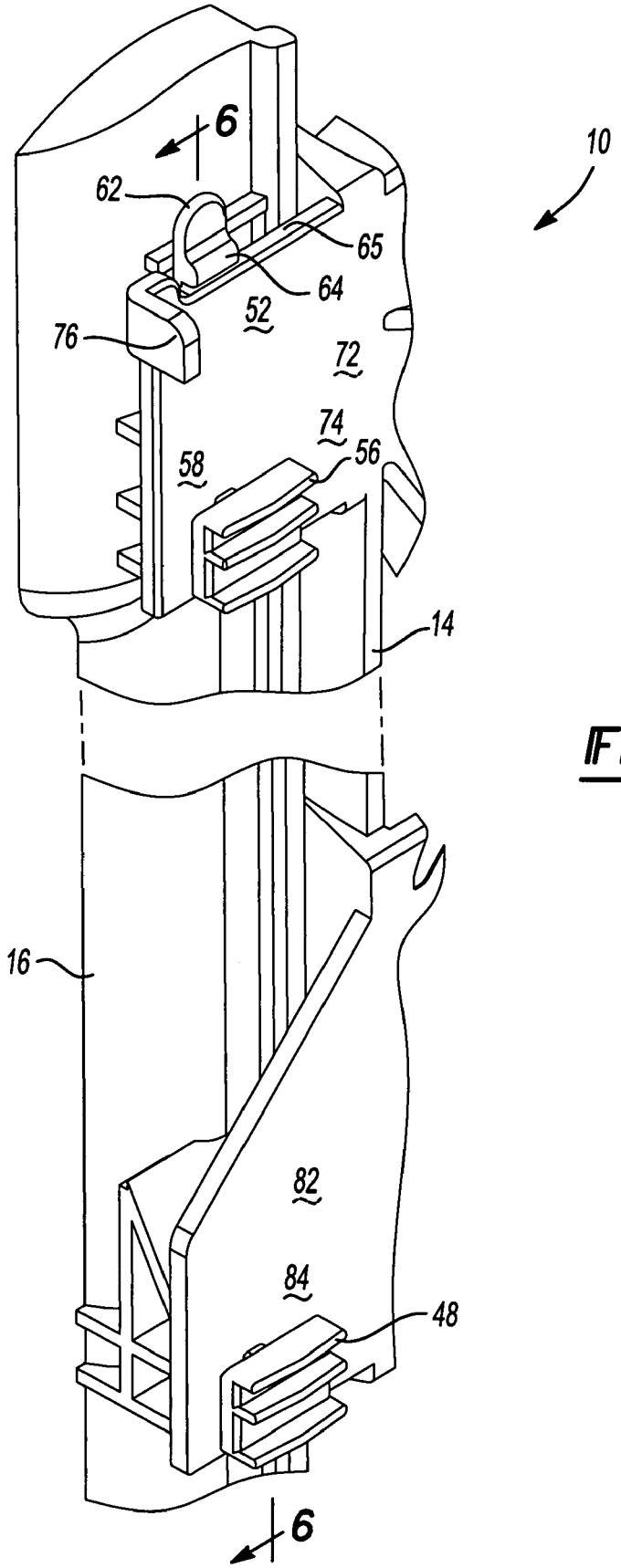
FIG. 4 is an enlarged perspective view of a partially assembled engine cooling module utilizing the fastening system.

FIG. 4 is an enlarged perspective view of a partially assembled engine cooling module 10 utilizing the fastening system of the teachings of the present invention. More specifically, FIG. 4 depicts the top fan support plate 52 in its assembled position against the top latch surface 58 of the radiator top latch 50. In this assembled position, and with reference to FIG. 5, the bottom fan plate groove, slot or notch 86 is inserted in accordance with arrow 87 into a radiator bottom post groove bottom 108 so that the bottom fan plate radiator side 82 is snugly against the radiator bottom post groove inner face 112 and the bottom fan plate shroud side 84 is against the radiator bottom post groove intermediate face 110. In such a sandwiched position, the electric fan support 14 is secured in the fore and aft directions when installed in a vehicle and during transportation and handling of the subassembly (the electric fan support 14 assembled to the radiator 16). Stated another way, the electric fan support 14 is secured from lateral movement which means that the fan support 14 can not move toward or away from the radiator 16.

Figure 5:
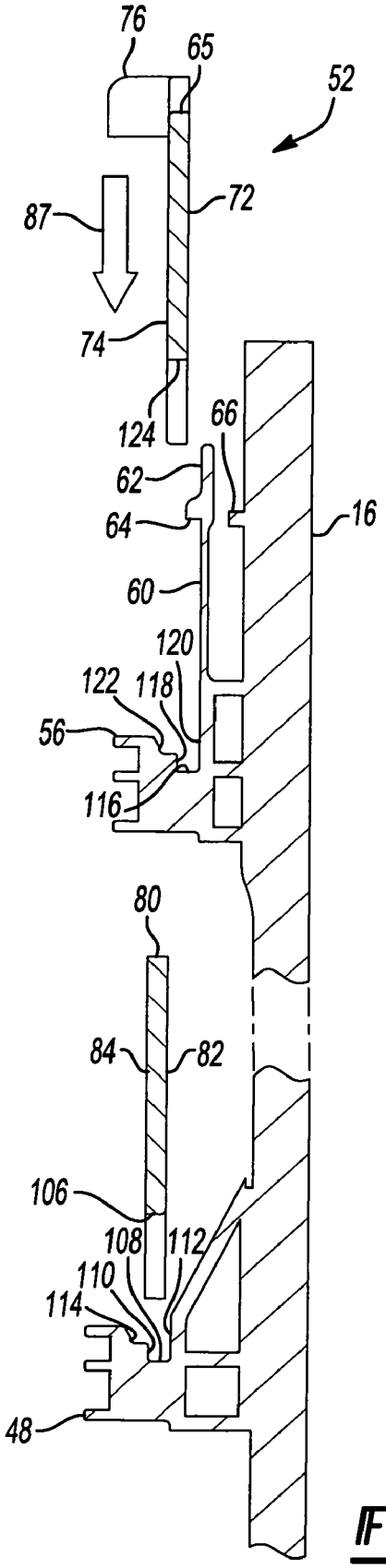
FIG. 5 is an enlarged cross-sectional view depicting a pre-assembly stage of the engine cooling module employing the fastening system.

Continuing with FIGS. 4 and 5, the top fan support plate 52 is lowered into the radiator top post groove 116 at the same time as the bottom fan support plate 80 is lowered into the radiator bottom post groove bottom 108. With the top plate 52, the top fan plate notch end 124 abuts and rests against the bottom of the radiator top post groove 116. Also, the bottom fan support plate notch end 106 abuts and rests upon a bottom of groove 108. Positioned as such, the top fan support plate radiator side 72 snugly abuts against the radiator top post groove inner face 120, and the face of the top spring lever 60. Additionally, the top fan support plate shroud side 74 snugly abuts against radiator top post groove intermediate face 118.

Figure 6:
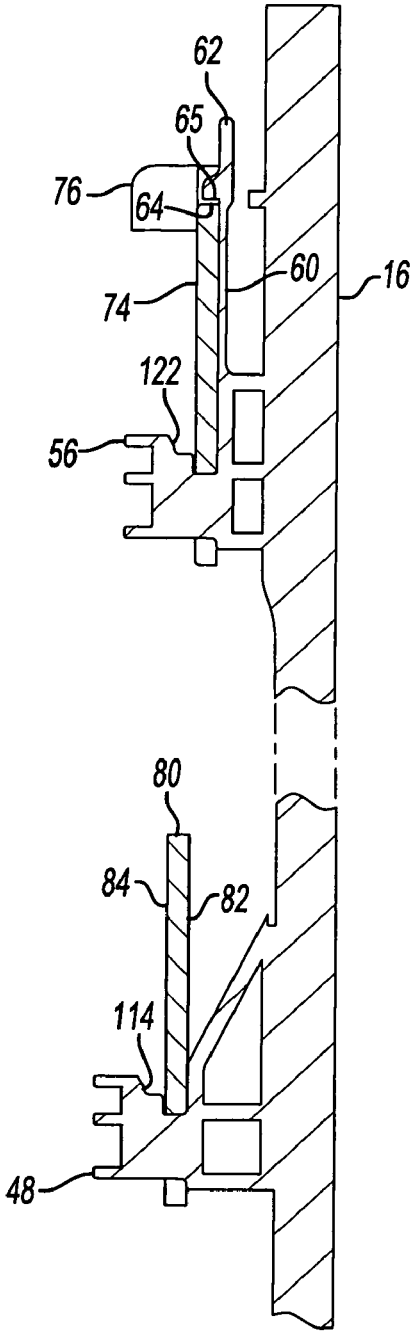
FIG. 6 is an enlarged cross-sectional view depicting a partially assembled stage of the engine cooling module employing the fastening system.

When the fan support 14 is lowered into its assembled position, as depicted in FIG. 6, the spring lever 60 and top spring tab 62 are biased away from the fan support 14 and then spring back when released such that the protuberance or latch tab 64 resides over the top fan support plate top surface 65. This secures the entire fan shroud 12 so that it can not move off of the posts 48, 56. To assist in securing the latch tab 64 over the top fan support plate top surface 65, the top spring tab 62 may be pressed by a human finger to bias the top spring lever 60 away from the top fan support plate 52; however, pressing by a human finger is not necessary. To prevent over bending of the top spring lever 60, which may fatigue the top spring lever 60 with repeated use, the top spring lever 60 will contact the stop 66. When the top spring lever 60 is released, it returns to its equilibrium or neutral stress position with the latch tab 64 over the top surface 65 of the top fan support plate 52. Again, FIG. 6 depicts the assembled parts that are depicted unassembled in FIG. 5. With the electric fan support 14 assembled against the radiator 16, the fan shroud 12 can then be assembled to the electric fan support 14 in a similar manner.

Before explaining further assembly of the fan shroud 12 to the assembly of the radiator 16 and the electric fan support 14, an additional advantage of the teachings of the present invention will be explained. With just the electric fan support 14 snapped or secured into position on the radiator 16, the two-part assembly can then be shipped for further assembly without any additional fasteners of any type. Prior to the teachings of the present invention, screws or a bolt and nut arrangement were necessary to secure the electric fan support 14 to the radiator 16 and then, further similar fasteners were necessary to prevent the two parts from detaching during physical transit to another location for further attachment of the fan shroud 12. However, the inventive structure of the groove 108, 116 and post 48, 56 arrangements, and the biasing top spring lever 60, such previously used fasteners for assembly and transit prior to fan shroud assembly are not necessary.

Figure 7:
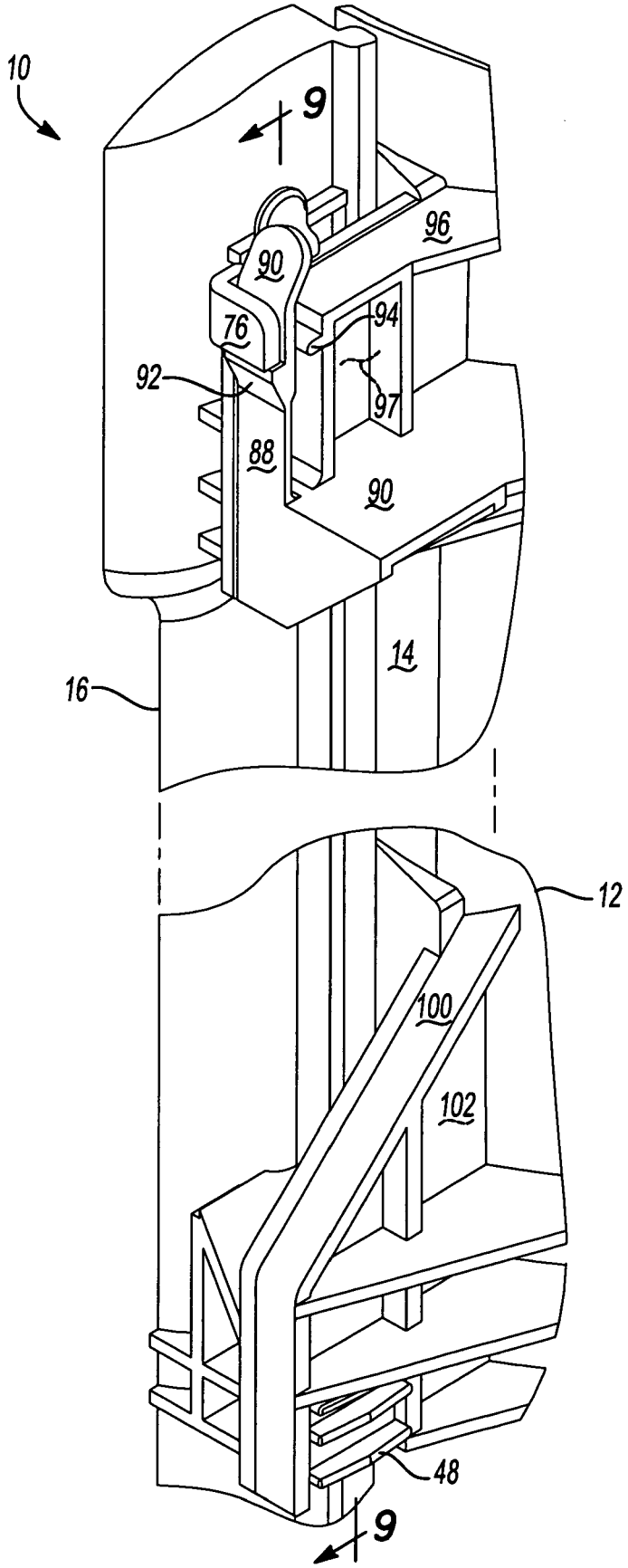
FIG. 7 is an enlarged perspective view of an assembled engine cooling module employing the fastening system.

Continuing with the assembly and teachings of the present invention, FIG. 7 depicts an enlarged partial perspective view of an assembled engine cooling module 10. More specifically, FIG. 7 depicts the engine fan shroud 12 mounted to the assembly of the radiator 16 and electric fan support 14. Continuing with reference to FIGS. 3 and 7-9, further assembly of the fan shroud 12 to the electric fan support 14 involves aligning the fan shroud bottom plate groove, slot or notch 104 within the bottom post shallow slot, notch or groove 115 between the radiator bottom post groove outer face 114 and the bottom fan support plate 80. When installation is complete, the fan shroud bottom plate notch end 130 will rest within the bottom post shallow groove 115. At the same time that alignment of the fan shroud bottom plate 100 (second bottom plate) occurs, so does alignment of the fan shroud latch 54. The fan shroud bottom plate (second bottom plate) surface 102 abuts the bottom fan plate (first bottom plate) shroud side 84.

With reference to FIGS. 3 and 7-9, alignment of the fan shroud latch 54 will be explained. When the fan shroud 12 is lowered in accordance with arrow 132, the fan shroud spring lever 88 biases as the angled surface of the fan shroud spring level lock tab 92 contacts the top plate extension tab 76 of the top fan support plate 52. As the biasing is occurring, the fan shroud top plate 55 (second top plate) begins to settle within the notch or groove 123 of the radiator top post 56. More specifically, the fan shroud top plate notch end 134 will settle within the notch 123 between the radiator top post groove outer face 122 and the top fan support plate shroud side 74. As that occurs, the fan shroud spring lever lock tab 92 snaps into place under the top plate extension tab 76. This installation places the fan shroud latch surface 97 (second top plate) securely against the top fan support plate shroud side 74 (first top plate). The assembly of the three pieces 12, 14, 16 completes the fan shroud assembly 10.

With the fan shroud 12, electric fan support 14, and radiator 16 securely assembled, one will recognize that the latch tab 64 over the top fan support plate (first top plate) top surface 65 and the top plate extension tab 76 over the fan shroud spring lever lock tab 92 prevents motion in the vertical, or up and down, direction while the posts 48, 56 lateral motion (off the end of the posts 48, 56). Additionally, for and aft motion with reference to vehicle installation is also prevented. However, one will also recognize that the posts 48, 56 also prevent downward motion (in the direction of arrow 132) of the electric fan support 14 and the fan shroud 12. The grooves 108, 116 and grooves 115, 123 also prevent motion along the length of the posts 48, 56. FIG. 8 depicts an enlarged cross-sectional view depicting a pre-assembly stage of the engine cooling module 10 while FIG. 9 depicts an enlarged cross-sectional view of the assembled engine cooling module 10.

While the teachings of the present invention have been described and largely depicted using the top connection device 44 and the bottom connection device 46, which are located on the left, or driver's side of a typical vehicle, a corresponding top connection device and bottom connection device are located on the right side of the vehicle, for a total of four connection devices. With a total of four connection devices, one at each corner of the cooling module assembly 10, the cooling module assembly can securely be held together.

The fan shroud 12, electric fan support 14 and radiator 16 may be constructed from metallic materials or non-metallic materials. Regarding the teachings of the present invention, as an example, the radiator 16, the electric fan support 14, and fan shroud 12 may be constructed of various plastics.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cooling module fastening system comprising:

a first member having a lower post and an upper post;

a second member having a first bottom plate defining a first slot such that the first bottom plate straddles the lower post and a first top plate defining a second slot such that the first top plate straddles the upper post, the lower and upper posts maintaining the second member against the first member; and a third member having a second bottom plate defining a third slot such that the third slot straddles the lower post and a second top plate defining a fourth slot such that the second top plate straddles the upper post, resulting in the second member being sandwiched between the first member and the third member.

2. The fastening system of claim 1, further comprising:

a first lever arm having a first tab, the first lever arm connected adjacent to the upper post on the first member, the first tab residing against the first top plate thereby preventing the second member from dislodging from the lower and upper posts.

3. The fastening system of claim 2, wherein the first lever arm is flexible.

4. The fastening system of claim 3, further comprising:

a first lever arm stop that limits bending of the first lever arm.

5. The fastening system of claim 2, further comprising:

a plate tab on the first top plate; and a second lever arm connected to the second top plate and having a second tab, the second tab lodging against the plate tab thereby preventing the third member from dislodging from the lower and upper posts.

6. The fastening system of claim 5, wherein the second lever arm is flexible.

7. The fastening system of claim 6, further comprising:

a second lever arm stop that prevents over bending of the second lever arm.

8. A cooling module fastening system comprising:

a first member having a lower post and an upper post;

a second member having a first bottom plate that straddles the lower post and a first top plate that straddles the upper post;

a first flexible lever arm having a first tab and connected to the first member adjacent to the upper post, wherein the first tab resides above the first top plate thereby preventing the second member from moving from the lower and upper posts;

a lower post lower groove;

an upper post lower groove, wherein the lower grooves prevent lateral movement of the second member;

a plate tab protruding from the first top plate;

a third member having a second bottom plate defining a third slot; and a second top plate defining a fourth slot, the third and fourth slots residing over the lower and upper posts, respectively, such that the third member is prevented from moving laterally.

9. The fastening system of claim 8, further comprising:

a lower post upper groove; and an upper post upper groove, wherein the lower post upper groove receives the third slot and the upper post upper groove receives the fourth slot.

10. The fastening system of claim 8, further comprising:

a second lever arm connected to the second top plate, the second lever arm further defining a second tab that lies adjacent the plate tab on the first top plate to prevent the third member from dislodging from the lower and upper posts.

11. The fastening system of claim 10, the first member further comprising:

a first lever arm stop, the first lever arm stop preventing excessive bending in the first lever arm.

12. The fastening system of claim 11, the third member further comprising:

a second lever arm stop, the second lever arm stop governing bending in the second lever arm.

13. A cooling module fastening system comprising:

a first member having:

a lower post defining a lower groove and an upper groove;

an upper post defining a lower groove and an upper groove;

a first lever arm defining a first tab, the first lever arm residing adjacent to the upper post; and a second member having:

a first bottom plate that defines a first groove; and a first top plate that defines a second groove;

wherein:

the first bottom plate first groove fits within the lower post lower groove and the first top plate second groove fits within the upper post lower groove; and the first tab of the first lever arm resides adjacent the first top plate to secure the second member against the lower and upper posts.

14. The cooling module fastening system of claim 13, further comprising:

a third member having:

a second bottom plate defining a third groove;

a second top plate defining a fourth groove; and a second lever arm defining a second tab;

wherein:

the second bottom plate third groove fits within the lower post upper groove and the second top plate fourth groove fits within the upper post upper groove; and the second member further defining:

a plate tab protruding from the first top plate;

wherein:

the second tab of the second lever arm lies adjacent to the plate tab to secure the third member against the lower and upper posts.

* * * * *